US005179896A

United States Patent [19]

Copeland

[11] Patent Number: 5,179,896

[45] Date of Patent: Jan. 19, 1993

[54] INDENT PRINTER FOR PLASTIC PIPE AND METHOD OF USE

[75] Inventor: James R. Copeland, Melrose Park, Ill.

[73] Assignee: Chevron Research & Technology Company, San Francisco, Calif.

[21] Appl. No.: 779,047

[22] Filed: Oct. 18, 1991

[51] Int. Cl.[5] ..... B41F 17/10

[52] U.S. Cl. ..... 101/6; 101/77; 226/97

[58] Field of Search ..... 101/6, 18, 36, 37, 75, 101/77; 254/393, 391; 226/97

[56] References Cited

U.S. PATENT DOCUMENTS

| | | | |
|---|---|---|---|
| 1,028,199 | 6/1912 | Dun Lany | 101/77 |
| 1,038.348 | 9/1912 | Gompf | 101/77 |
| 2,186,788 | 1/1940 | Olson | 101/37 X |
| 2,344,610 | 3/1944 | Hargreaves et al. | 101/36 |
| 2,898,848 | 8/1959 | Gillies et al. | 101/36 |
| 3,097,592 | 7/1963 | Friedman | 101/6 |
| 3,127,120 | 3/1964 | Selsted et al. | 226/97 X |
| 3,635,153 | 1/1972 | Gartside | 101/37 |
| 3,788,213 | 1/1974 | Brown et al. | 101/37 |

*Primary Examiner*—Clifford D. Crowder
*Attorney, Agent, or Firm*—Burns, Doane, Swecker & Mathis

[57] ABSTRACT

An indent printer having a marking wheel with a plurality of printing heads operatively connected to the periphery thereof, at least one of the printing heads being adjustable to change printing type indicia and at least one support roller being spaced from the marking wheel, the circumference of the support roller being positioned relative to the marking wheel to support therebetween a moving substrate to be marked, and a method of adjustably marking are disclosed.

13 Claims, 3 Drawing Sheets

INDENT PRINTER FOR PLASTIC PIPE AND METHOD OF USE

BACKGROUND OF THE INVENTION

1. Field of the Invention

The invention relates to printers for continuously marking extruded plastic products, and more specifically, to rotary printers which use heat, pressure, and film-backed marking tape to apply an embedded mark in plastic pipe.

2. Prior Art

In the past, rotary hot-foil leaf/brander marking machines have been developed to be installed directly between sizing and take-off equipment on an extrusion line. These friction-driven marking systems for smooth plastic pipe use a marking wheel into the periphery of which individual type of numerals and/ or letters may be set. The wheel is rotated by means of contact with the moving pipe to imprint the pipe, and specifically to press portions of a foil tape into the surface of the pipe. Unfortunately, such devices require a great deal of set-up time to set the individual type in the periphery of the marking wheel and to fixture the marking wheel relative to the surface of a pipe fixed diameter. The type and the position of the marking wheel are incapable of being changed during an extrusion run.

The subject invention overcomes these disadvantages by providing a device that is easily adjustable for different printed indicia, pipe sizes and variations of printed indicia during a continuous extrusion run.

SUMMARY OF THE INVENTION

The purpose of the invention is to provide a device that is easily adjusted to accommodate a variety of pipe diameters and indicia on the surface of the pipe before and during extrusion of the pipe. To accomplish this purpose there is provided a device having a heated marking wheel with a plurality of tumbler type printing heads on the periphery thereof in combination with a diametrically adjustable roller to accommodate changes in printing indicia and varying pipe diameters. The tumbler type printing heads of the present invention are further adjustable during movement of the marking wheel to change printing indicia and to further provide a footage mark to the continuously moving pipe substrate. Other unique features such as a floating mount mechanism to which the rotating printing head is mounted carefully to control the depth of printing and a unique vortex marking tape take-up for printing tape are also part of the invention.

In one aspect there is provided an indent printer comprising: a marking wheel having a plurality of printing heads operatively connected to the periphery thereof, at least one of said printing heads being adjustable to change printing type indicia; and at least one support roller spaced from said marking wheel and the circumference of said support roller being positioned to support a moving substrate to be marked.

In another aspect there is provided a method of indent printing comprising the steps of:

providing a continuously moving substrate;

rotating a marking wheel relative to said substrate to contact said substrate; providing a marking tape between said marking wheel and said substrate;

providing at least one printing head having printing indicia on the periphery of said marking wheel; and changing the indicia of said printing head on said marking wheel.

DESCRIPTION OF THE PREFERRED EMBODIMENT

Figure 1:
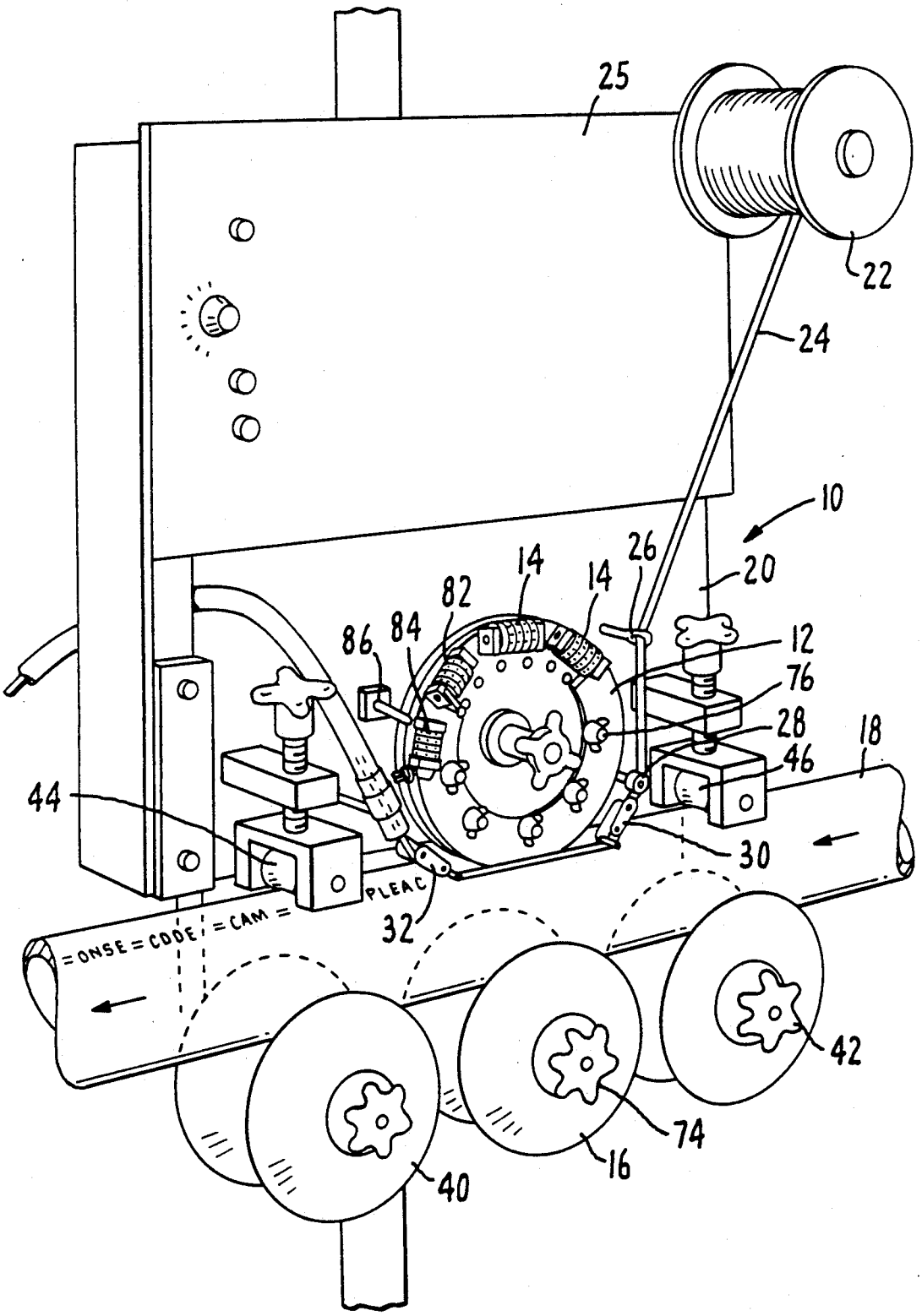
FIG. 1 is a perspective view of the indent printer of the invention in operation marking a moving substrate in the form of a plastic tube.

With continued reference to the drawing, FIG. 1 illustrates an indent printer, shown generally at 10, according to the invention. Indent printer 10 includes a marking wheel 12 having a plurality of printing heads 14 and at least one support roller 16 to support a moving substrate 18 shown to be a plastic pipe therebetween. Marking wheel 12 is rotatably mounted to moveable mount means 20 for movement toward and away from support roller 16. Marking wheel 12 is preferably heated by conventional radiant heating means, or the like, preferably associated with mount means, to maintain a uniform temperature of the printing heads 14.

A reel 22 of marking tape 24 is attached to non-moveable support frame 26. Marking tape 24 is fed through frame 25 partially around guide spool 28 and under pivoting safety switch 30 to position marking tape 24 between marking wheel 12 and substrate 18 to be marked. As can be seen more clearly in FIG. 2, tape 24 positioned between a printing head 14 and substrate 18. Tape 24 will be pulled along as marking wheel 12 is rotated by movement of the substrate 18 as indicated by the directional arrows on substrate 18.

Marking tape 24 is then led under second safety switch 32 which is also pivotally mounted. Marking tape 24 is then drawn into take-up tube 34 which provides suction to remove the used marking tape 24. Suction is provided by introducing pressurized air in conventional fashion through the back of fitting 36 having a narrowed venturi tube cross-section 38, shown in phantom line.

Lever mounted safety switch 30 and second safety switch 32 are spring-loaded to press against marking tape 24 during operation of the indent printer 10. Should marking tape 24 break the levers of the safety switches, the safety switches will, because of their spring bias, rotate and actuate to sound an alarm. Tape reel 22 marking tape 24, frame 26, spool 28, safety switch 30 and second safety switch 32 take-up tube 34, and associated hardware discussed above are components of what is generally referred to as the "tape means".

Figure 2:
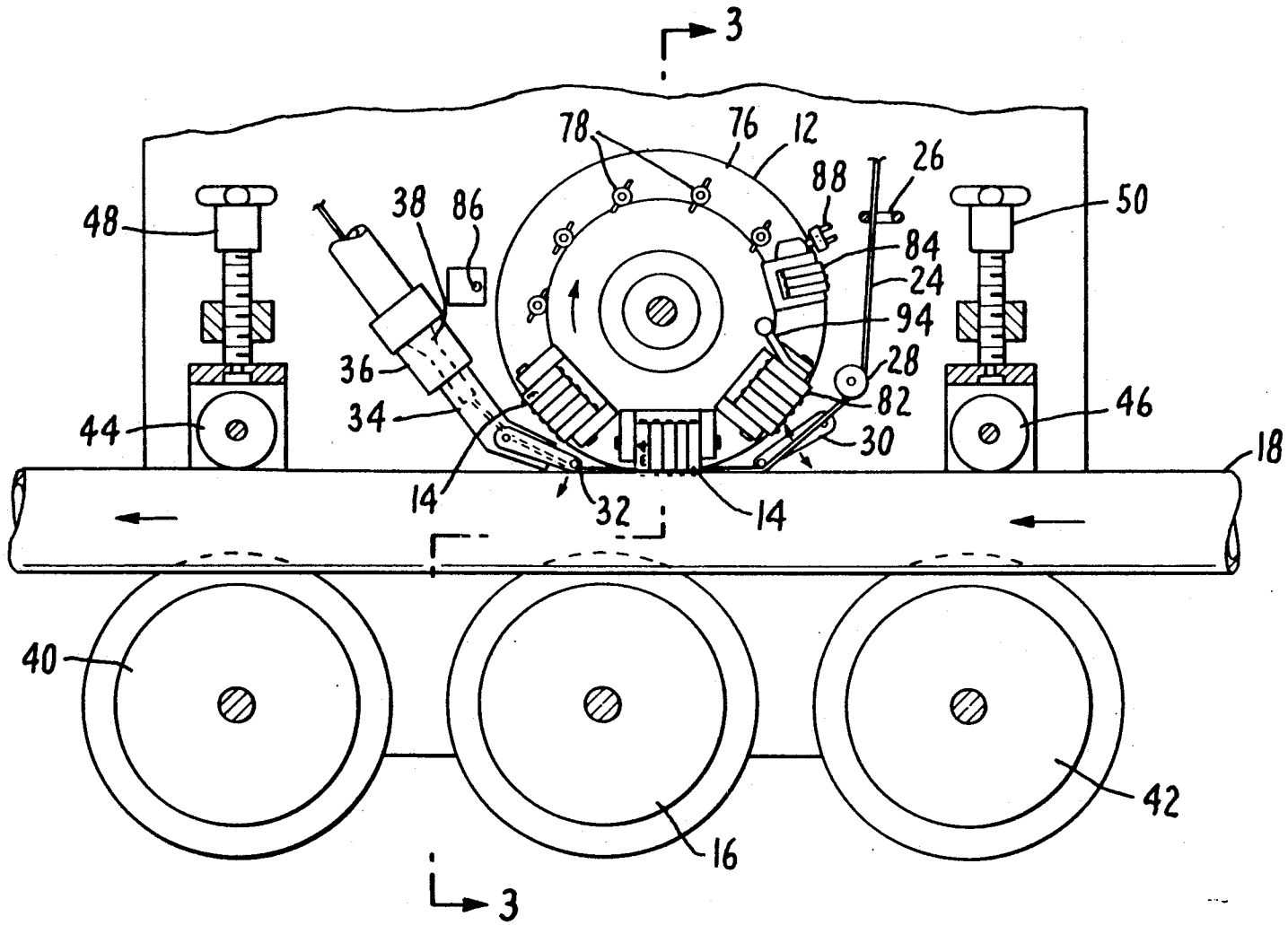
FIG. 2 is a partial front view of the marking wheel, mount means and guide means shown in FIG. 1.

FIGS. 1 and 2 also illustrate additional support rollers 40 and 42 and guide means 44 and 46. Although two guide means 44 and 46 are shown, it is understood that it is within the scope of the invention to use only one guide means 44 or 46 which floats on the moving substrate 18 to control spacing of the printing heads 14, relative to the substrate 18. Guide means 44 and 46 are adjustable by means of adjustment means 48 and 50, respectively. As one or both adjustment means 48 and/or 50 are changed, the height of the printing head 14 tangent to the substrate (pipe) is changed. In this way the adjustment of the depth of the type imprinting the marking tape into the substrate 18 is controlled. As seen in FIG. 2, the additional support rollers 40 and 42 are ideally positioned in alignment with guide means 44 and 46. Guide means 44 and 46 are shown to include contoured rollers which rotate easily upon the surface of the substrate 18. It is understood that other low friction mechanical means, such as skid plates, are also within the scope of the invention.

Guide means 44 and 46 are attached to mount means 20 carrying marking wheel 12. Mount means 20 is vertically moveable (adjustable and floatable) by two mechanisms. Frame 25 includes a rigidly attached rack member 52 onto which sub-assemblies are vertically adjustable by pinion gear means 54 and 56. Pinion gear 54 is connected to sub-assembly 58 which is, in turn, floatably supporting mount means 20. Pinion gear means 56 is connected to the second sub-assembly 60 to which the support rollers 16, 40 and 42 are attached. Guide means 44 and 46, marking wheel 12 and mount means 20 are adjustable relative to substrate 18 and support rollers 16, 40 and 42 by vertical movement initiated by pinion gear means 54 or the pneumatic piston and cylinder having shaft 62 shown to be interconnected to mount means 20. The pneumatic piston and cylinder arrangement interconnects mount means 20 to sub-assembly 58 by conventional means understood to those skilled in the art. After mount means 20 is generally positioned relative to substrate 18 by pinion gear means 54, it is capable of being raised and lowered by shaft 62. The pneumatic piston and cylinder arrangement controlling shaft 62 is then relaxed, allowing mount means 20 and all connected components to float on substrate 18. Weight of the mount means 20 and other hardware being carried by guide means 44 and/or 46 which are adjustable, as discussed earlier.

Figure 3:
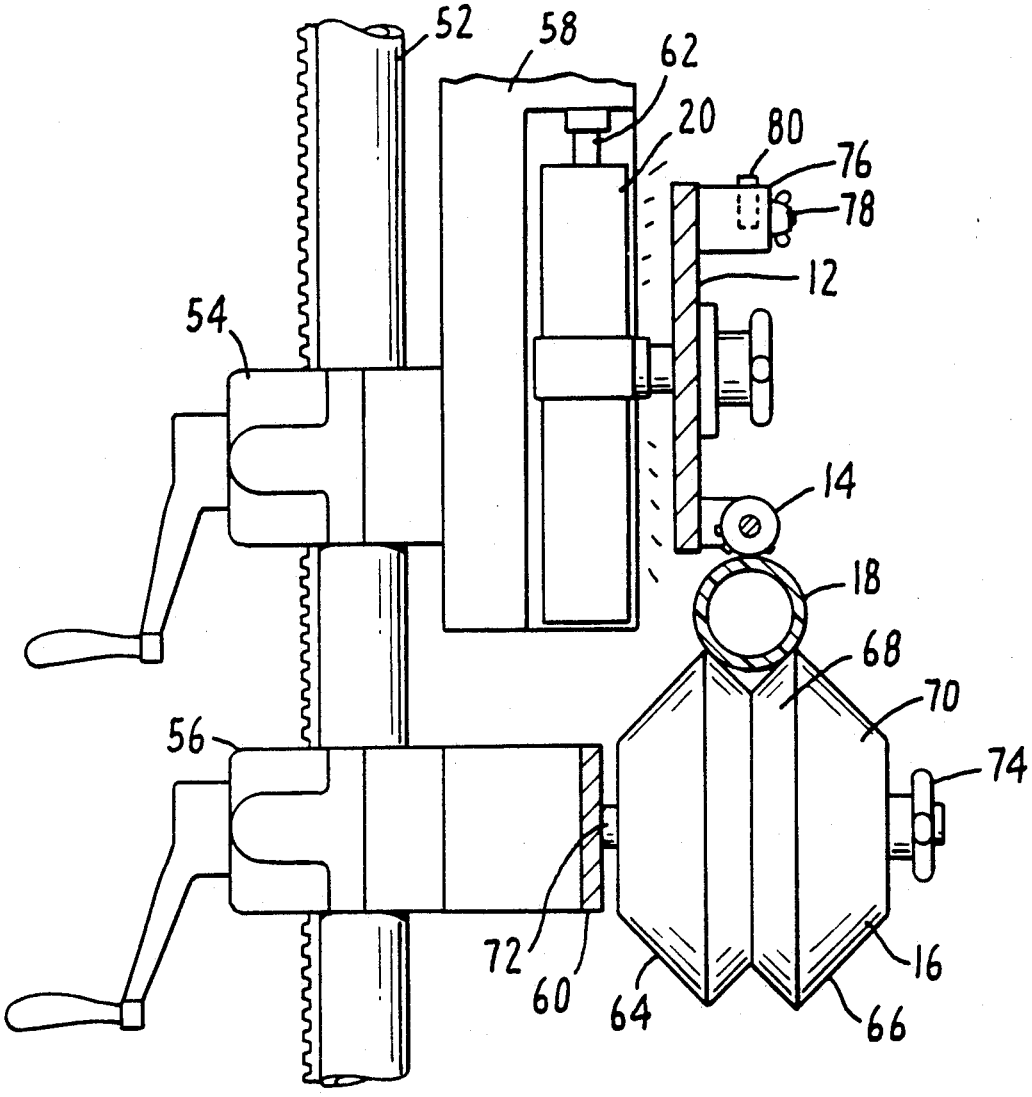
FIG. 3 is an enlarged, partial sectional view taken along section line 3—3 in FIG. 2 illustrating the support roller of the invention along with the adjustable floating mount means and guide means for the marking wheel.
Figure 4:
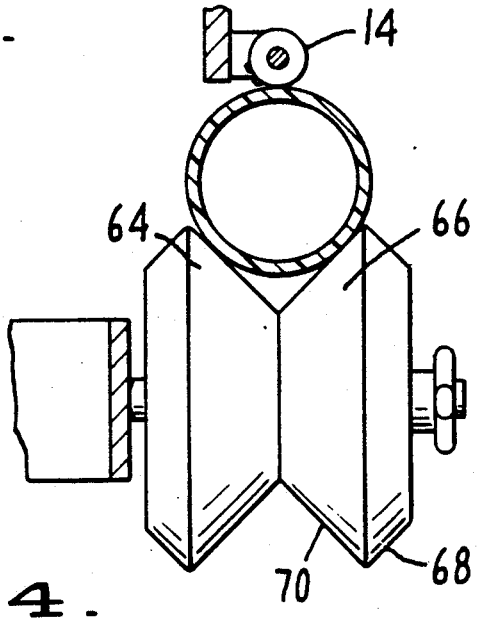
FIG. 4 is an enlarged, partial sectional view similar to FIG. 3 illustrating the bifurcated support roller, each part of which has been symmetrically reversed to accommodate the larger diameter pipe.

Pinion gear means 56 is used to adjust vertical movement of support rollers 16, 40 and 42. In addition to the general vertical adjustment made possible by a change in pinion gear means 56, support roller 16, as well as support rollers 40 and 42, are inherently adjustable to accommodate different sized substrates, i.e., different diameter pipes. In FIGS. 3 and 4, this additional adjustment is illustrated. All of the support rollers, including support roller 16, are bifurcated into two double frusto-conical rollers 64 and 66; rollers 64 and 66 are mounted symmetrically with respect to each other. Since the double frusto-conical rollers 64 and 66 are identical, only one will be described in detail. Double frusto-conical roller 66 has frusto-conical portions 68 and 70. The angle of the inclined surfaces of portions 68 and 70 relative to the radius of the support roller 16 are shown to be equal, but the depth of each portion 68 and 70 is shown to be different. Portion 68 is narrowed in axial thickness than portion 70. Rollers 64 and 66 are removeably secure on shaft 72 by locking hub 74. As seen in FIG. 4, rollers 64 and 66 have been removed from shaft 72, and each roller 64 and 66 has been rotated such that a deeper "V" shape has been created.

As seen in FIG. 1 and FI G. 3, marking wheel 12 also includes flange 76 attached by fasteners 78. Flange 76 is provided with recesses into which type 80 may be set for indicia that remains constant over a given marking. Such indicia may be a company name or spacing marks (dashes or double dashes) which label the substrate and also help to maintain frictional contact between the marking wheel 12 and the substrate 18 to ensure uniform rotation of marking wheel 12. Although flange 76 is shown, it is understood that other equivalent mechanical means which would present a circumference of type are within the scope of the invention. Flange 76, fastener 78 and type 80 are defined as printing means around the circumference of the marking wheel.

Marking wheel 12 includes printing heads 82 and 84 which are adjustable during rotation of the marking wheel. Printing head 84 is adjusted each revolution by intermittent contact with trip means 86 which is connected to mount means 20. Printing head 84 includes lever arm 88 which contacts trip member 86 on each revolution and causes rotation of at least one tumbler in printing head 84. Printing head 84 is useful to mark uniform links of substrate 18.

Printing head 82 includes manually-operated control lever 94 which may be contacted periodically during the continuous movement of substrate 18 to indicate a change in conditions, such as a change of shift or operator of the equipment.

Each printing head 14, 82 and 86 is of tumbler configuration, each tumbler having a plurality of printing indicia on the periphery thereof, said tumblers being rotatable relative to each other to present selected indicia at the circumference of the marking wheel 12 to contact substrate 18 to be marked. The tumblers of printing heads 82 and 84 are adjustable with respect to each other during rotation of the marking wheel 12. The tumblers of printing head 84 are changed by lever arm 88 which hits trip member 86 with each revolution of the marking wheel 12. Various tumbler type printing heads, such as those used in postage machines and similar devices where each tumbler may be rotated relative to another to change indicia, are suitable in this invention. Such printing heads, which are also referred to in the trade as "numbering dials", are available in various sizes and with a selection of numerals and/or letters from the Atlantic Force Numbering Machine Company, a division of Atlantic Control Systems of Brooklyn, N.Y.

It can be seen from the above description of the apparatus that a method of indent printing has been disclosed, including the steps of providing a continuously moving substrate 18 of pipe, rotating a marking wheel 12 relative to the substrate 18 to contact the substrate, providing a marking tape 24 between the marking wheel 12 and the substrate 18 and providing at least one printing head 14, 82, or 84 having printing indicia on the periphery of the marking wheel and adjusting the printing heads 14, 82, 84 while the printing heads are on the marking wheel and even when in contact with the substrate 18 to change the printing indicia. In the case of printing heads 14, they may be adjusted easily while the marking wheel 12 is on the machine, and in case of printing heads 82 and 84, they may be adjusted even while the marking wheel 12 is in rotation.

Having indicated above the preferred embodiment of the present invention, it will occur to those skilled in the art that modifications and alternatives can be practiced within the spirit of the invention. It is accordingly intended to define the scope of the invention only as indicated in the following claims.

What is claimed is:

1. An indent printer comprising:

a marking wheel having a plurality of printing heads operatively connected to the periphery thereof, at least one of said printing heads being adjustable to change printing type inidicia; and at least one support roller spaced from said marking wheel, the circumference of said support roller being complimentary to said marking wheel to support therebetween a moving substrate of plastic pipe to be marked, said marking wheel being rotatably connected to a movable mount means for movement toward and away from said support roller, said movable mount means being vertically adjustable relative to said support roller, said movable mount means including means to heat said marking wheel to maintain uniform elevated temperature of said printing heads to affect printing, said mount means further including at least one guide means adjustably connected to said mount means to contact and ride on the surface of a plastic pipe to be marked to floatably support the weight of said mount means and said marking wheel upon such a surface to control the vertical spacing of said printing heads relative to such a surface.

2. A printer as in claim 1 including an additional guide means adjustably connected to said mount means to likewise contact the surface of a plastic pipe to be marked and to support a portion of the weight of said mount means and marking wheel along with said other guide means, said marking wheel positioned between said guide means and said additional guide means relative to the direction of movement of plastic pipe to be marked.

3. A printer as in claim 1 wherein said support roller is axially bifurcated into two double frusto-conical rollers, each double frusto-conical roller being mounted symmetrically with respect to each other and defining a V-shaped support roller to contact and position a substrate to be marked.

4. A printer as in claim 3 wherein said double frusto-conical rollers are axially and symmetrically reversible with respect to each other to alter the depth of said V shape to accommodate a different diameter of substrate to be marked.

5. A printer as in claim 1 wherein said marking wheel includes printing means around the circumference thereof in addition to said printing heads.

6. A printer as in claim 1 wherein each printing head that is adjustable is of tumbler configuration, each tumbler having a plurality of printing indicia on the periphery thereof, said tumblers being rotatable relative to each other to present selected indicia at the circumference of the marking wheel to contact a substrate to be marked.

7. A printer as in claim 6 wherein said tumblers are adjustable with respect to each other during rotation of the marking wheel.

8. A printer as in claim 7 further including trip means operatively connected to said marking wheel to change the tumblers of at least one printing head per revolution of said marking wheel.

9. A printer as in claim 1 further including tape means to continuously provide a marking tape between said marking wheel and a substrate to be marked.

10. A printer as in claim 9 wherein said tape means further includes a take-up tube providing suction to the marking tape from said tape means after said tape passes between said printing head and a substrate to be marked to remove said marking tape.

11. A method of indent printing comprising the steps of:

providing a continuously moving substrate of plastic pipe;

rotating a marking wheel relative to said substrate to contact said substrate;

providing at least one printing head moving printing indicia on the periphery of said marking wheel;

changing the indicia on said marking wheel;

adjustably supporting said marking wheel on a mount means having a guide means;

placing the guide means in contact with the surface of said plastic pipe and floatably supporting the weight of said mount means and said marking wheel on said surface to control the vertical spacing of said printing head relative to said surface;

heating and marking wheel; and providing a marking tape between said marking wheel and said plastic pipe.

12. A method as in claim 11 wherein said step of changing said printing head and said indicia occurs while said marking wheel is moving.

13. A method as in claim 12 further including the step of changing the indicia on said printing heads occurs with each revolution of said marking wheel to indicate a predetermined length on the substrate being marked.

* * * * *

UNITED STATES PATENT AND TRADEMARK OFFICE

CERTIFICATE OF CORRECTION

PATENT NO. : 5,179,896

DATED : January 19, 1993

INVENTOR(S) : James R. Copeland

It is certified that error appears in the above-identified patent and that said Letters Patent is hereby corrected as shown below:

Column 5, line 4, delete [inidicia] and insert --indicia--.

Column 6, line 27, delete [moving] and insert --having--.

Signed and Sealed this

Eleventh Day of January, 1994

Bruce Lehman

*Attest:*

BRUCE LEHMAN

*Attesting Officer*

*Commissioner of Patents and Trademarks*